US010149074B2

(12) United States Patent
Courtois et al.

(10) Patent No.: US 10,149,074 B2
(45) Date of Patent: Dec. 4, 2018

(54) HEARING ASSISTANCE SYSTEM

(71) Applicant: SONOVA AG, Staefa (CH)

(72) Inventors: Gilles Courtois, Echandens (CH); Patrick Marmaroli, Thonon (FR); Herve Lissek, Renens (CH); Yves Oesch, Neuchatel (CH); William Balande, Fribourg (CH)

(73) Assignee: Sonova AG

( * ) Notice: Subject to any disclaimer, the term of this patent is extended or adjusted under 35 U.S.C. 154(b) by 0 days.

(21) Appl. No.: 15/545,301

(22) PCT Filed: Jan. 22, 2015

(86) PCT No.: PCT/EP2015/051265
§ 371 (c)(1),
(2) Date: Jul. 20, 2017

(87) PCT Pub. No.: WO2016/116160
PCT Pub. Date: Jul. 28, 2016

(65) Prior Publication Data
US 2018/0020298 A1 Jan. 18, 2018

(51) Int. Cl.
*H04R 25/00* (2006.01)

(52) U.S. Cl.
CPC ..... *H04R 25/554* (2013.01); *H04R 25/552* (2013.01); *H04R 25/407* (2013.01); *H04S 2420/01* (2013.01); *H04S 2420/07* (2013.01)

(58) Field of Classification Search
CPC .. H04R 25/407; H04R 25/552; H04R 25/554; H04S 2420/01; H04S 2420/07
See application file for complete search history.

(56) References Cited

U.S. PATENT DOCUMENTS

| | | | | |
|---|---|---|---|---|
| 8,208,642 | B2 | 6/2012 | Edwards | |
| 8,526,647 | B2 | 9/2013 | Pedersen et al. | |
| 9,699,574 | B2 | 4/2017 | Gran et al. | |
| 2005/0191971 | A1* | 9/2005 | Boone | H04R 25/554 455/575.1 |

(Continued)

FOREIGN PATENT DOCUMENTS

| | | |
|---|---|---|
| EP | 2584794 | 4/2013 |
| WO | WO-2007/031896 | 3/2007 |

(Continued)

OTHER PUBLICATIONS

International Search Report and Written Opinion received in International Application No. PCT/US2015/051265, dated Sep. 17, 2015.

(Continued)

*Primary Examiner* — Brian Ensey

(57) ABSTRACT

There is provided a hearing assistance system, comprising a transmission unit comprising a microphone arrangement for capturing audio signals from a voice of a speaker using the transmission unit and being adapted to transmit the audio signals as radio frequency signal via a wireless RF link; a left ear hearing device and a right ear hearing device, each hearing device being adapted to stimulate the user's hearing and to receive an RF signal from the transmission unit via the wireless RF link and comprising a microphone arrangement for capturing audio signals from ambient sound.

38 Claims, 5 Drawing Sheets

(56) References Cited

U.S. PATENT DOCUMENTS

| | | | |
|---|---|---|---|
| 2011/0293108 | A1 | 12/2011 | Mejia et al. |
| 2016/0192090 | A1 | 6/2016 | Gran et al. |
| 2017/0171672 | A1 | 6/2017 | Recker et al. |

FOREIGN PATENT DOCUMENTS

| | | |
|---|---|---|
| WO | WO-2010/115227 | 10/2010 |
| WO | WO-2011/015675 | 2/2011 |
| WO | WO-2011/017748 | 2/2011 |

OTHER PUBLICATIONS

Rohdenburg, et al., "Combined source tracking and noise reduction for application in hearing aids", *8. ITG—Fachtagung Sprachkommunikation*, Aachen, Germany, Oct. 2008.

Qingyun, et al., "Sound localization and directed speech enhancement in digital hearing aid in reverberation environment", *Journal of Applied Sciences*, 13(8):1239-1244, 2013.

Wu, et al., "Hearing aid system with 3d sound localization", *TENCON*, IEEE Region 10 Conference, pp. 1-4, 2007.

* cited by examiner

HEARING ASSISTANCE SYSTEM

The invention relates to a system for providing hearing assistance to a user, comprising a transmission unit comprising a microphone arrangement for capturing audio signals from a voice of speaker using the transmission unit and being adapted to transmit the audio signals as radio frequency (RF) signal via a wireless RF link, a left ear hearing device to be worn at or at least partially in the user's left ear and a right ear hearing device to be worn at or at least partially in the user's right ear, each hearing device being adapted to stimulate the user's hearing and to receive an RF signal from the transmission unit via the wireless RF link and comprising a microphone arrangement for capturing audio signals from ambient sound; the hearing devices being adapted to communicate with each other via a binaural link.

Such systems, which increase the signal-to-noise (SNR) ratio by realizing a wireless microphone, are known for many years and usually present the same monaural signal, with equal amplitude and phase, to both left and right ears. Although such systems achieve the best possible SNR, there is no spatial information in the signal, so that the user cannot know where the signal is coming from. As a practical example, a hearing-impaired student in a classroom equipped with such system, when concentrated on his work while reading a book, with the teacher walking around in the classroom and suddenly starting talking to him, the student has to raise the head and start looking for the teacher left or right arbitrarily, since he cannot find directly where the teacher is located as he perceives the same sound on both ears.

In general, it is very important to be able to localize sounds, in particular sounds that announce a danger (e.g. car approaching while crossing a road, alarm being fired, . . . ). In everyday life it is also very common to turn the head in the direction of an incoming sound.

It is well known that a normal hearing person has an azimuthal localization accuracy of a few degrees. Depending on the hearing loss, a hearing impaired person may have a much lower ability to feel where the sound is coming from, and is perhaps barely able to detect if it is coming from left or right.

Binaural sound processing in hearing aids has been available for several years now, encountering several issues. First, the two hearing aids are independent devices, which imply unsynchronized clocks and difficulties to process both signals together. Acoustical limitations must also be considered: low SNR and reverberation are detrimental for binaural processing, and the possible presence of several sound sources makes the use of binaural algorithm tricky.

The article "Combined source tracking and noise reduction for application in hearing aids, by T. Rohdenburg et al., in 8. *ITG-Fachtagung Sprachkommunikation*, Aachen, Germany, October 2008, addresses the problem of sound source direction of arrival (DOA) estimation with hearing aids. The authors assumed the presence of a binaural connection between left and right hearing aids, arguing that the full-band audio information could be transmitted from one device to the other in "a near future". Their algorithm is based on cross-correlation computations over 6 audio channels (3 per ears) allowing the use of the so-called SRP-PHAT method (steering response power over phase transformed cross-correlations).

The article "Sound localization and directed speech enhancement in digital hearing aid in reverberation environment" by W. Qingyun et at, in *Journal of Applied Sciences,* 13(8):1239-1244, 2013, proposes a three dimensional (3D) DOA estimation and directed speech enhancement scheme for glasses digital hearing aids. The DOA estimation is based on a multichannel adaptive eigenvalue decomposition algorithm (AED) and the speech enhancement is ensured by a wideband beamforming process. Again the authors supposed that all the audio signals are available and comparable, and their solution needs 4 microphones disposed on the glasses arms. 3D localization for hearing impaired people had been addressed in the article "Hearing aid system with 3d sound localization, by W.-C. Wu et al., in *TENCON, IEEE Region* 10 *Conference*, pages 1-4, 2007, by the mean of a five microphone array worn on the patient chest.

WO 2011/015675 A2 relates to a binaural hearing assistance system with a wireless microphone, enabling azimuthal angular localization of the speaker using the wireless microphone and "spatialization" of the audio signal derived from the wireless microphone according to the localization information. "Spatialization" means that the audio signals received from the transmission unit via the wireless RF link are distributed onto a left ear channel supplied to the left ear hearing device and a right ear channel supplied to the right ear hearing device according to the estimated angular localization of the transmission unit in a manner so that the angular localization impression of the audio signals from each transmission unit as perceived by the user corresponds to the estimated angular localization of the respective transmission unit. According to WO 2011/015675 A2, the received audio signals are distributed onto the left ear channel and the right ear channel by introducing a relative level difference and/or a relative phase difference between the left ear channel signal part and the right ear channel signal part of the audio signals according to the estimated angular localization of the respective transmission unit. According to one example, the received signal strength indicator ("RSSI") of the wireless signal received at the right ear hearing aid and the left ear hearing aid is compared in order to determine the azimuthal angular position from the difference in the RSSI values, which is expected to result head shadow effects. According to an alternative example, the azimuthal angular localization is estimated by measuring the arrival times of the radio signals and the locally picked up microphone signal at each hearing aid, with the arrival time differences between the radio signal and the respective local microphone signal being determined from calculating the correlation between the radio signal and the local microphone signal.

US 2011/0293108 A1 relates to a binaural hearing assistance system, wherein the azimuthal angular localization of a sound source is determined by comparing the auto-correlation and the interaural cross-correlation of the audio signals captured by the right ear hearing device and the left ear hearing device, and wherein the audio signals are processed and mixed in a manner so as to increase the spatialization of the audio source according to the determined angular localization.

A similar binaural hearing assistance system is known from WO 2010/115227 A1, wherein the interaural level difference ("ILD") and the interaural time difference ("ITD") of sound emitted from a sound source, when impinging on the two ears of a user of the system, is utilized for determining the angular localization of the sound source.

U.S. Pat. No. 8,526,647 B2 relates to a binaural hearing assistance system comprising a wireless microphone and two ear-level microphones at each hearing device. The audio signals as captured by the microphones are processed in a manner so as to enhance angular localization cues, in particular to implement a beam former.

U.S. Pat. No. 8,208,642 B2 relates to a binaural hearing assistance system, wherein a monaural audio signal is processed prior to being wirelessly transmitted to two ear level hearing devices in a manner so as to provide for spatialization of the received audio signal by adjusting the interaural delay and interaural sound level difference, wherein also a head-related transfer function (HRTF) may be taken into account.

Also WO 2007/031896 A1 relates to an audio signal processing unit, wherein an audio channel is transformed into a pair of binaural output channels by using binaural parameters obtained by conversion of spatial parameters.

It is an object of the invention to provide for a binaural hearing assistance system comprising a wireless microphone, wherein the audio signal provided by the wireless microphone can be perceived by the user of the hearing devices in a "spatialized" manner corresponding to the angular localization of the user of the wireless microphone, wherein the hearing devices have a relatively low power consumption, while the spatialization function is robust against reverberation and background noise. It is a further object of the invention to provide for a corresponding hearing assistance method.

According to the invention these objects are achieved by a hearing assistance system as defined in the claims.

The invention is beneficial in that, by using the RF audio signal received from the transmission unit as a phase reference for indirectly determining the interaural phase difference between the audio signal captured by the right ear hearing device microphone and the audio signal captured by the left ear hearing device microphone, the need to exchange audio signals between the hearing devices in order to determine the inter aural phase difference is eliminated, thereby reducing the amount of data transmitted on the binaural link and so the power. On the other hand, by using not only the estimated interaural phase difference, but also the interaural audio signal level difference and the interaural RF signal difference, such as an interaural RSSI difference, it is possible to increase the stability of the angular localization estimation and its robustness against reverberation and background noise so that the reliability of the angular localization estimation can be enhanced.

Preferred embodiments of the invention are defined in the dependent claims.

Hereinafter, examples of the invention will be illustrated by reference to the attached drawings, wherein.

Figure 1:
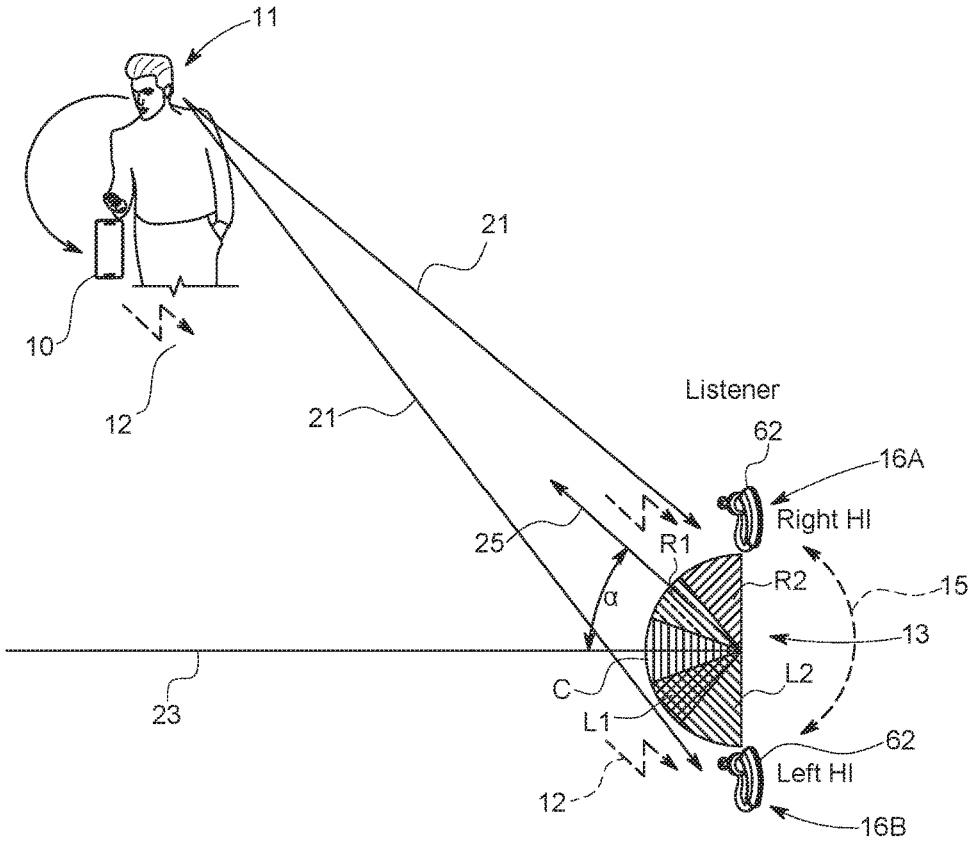
FIGS. 1 and 2 are illustrations of typical use situations of an example of a hearing assistance system according to the invention.
Figure 2:
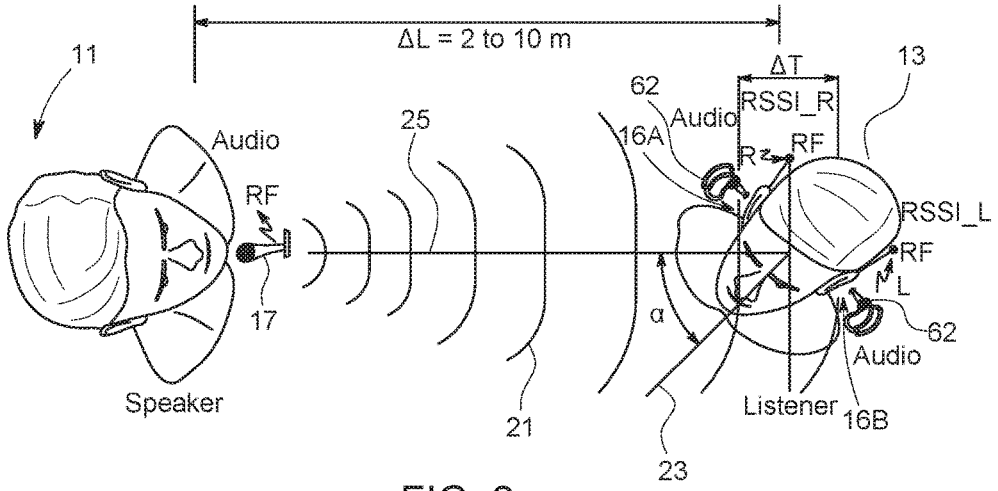

According to the example shown in FIGS. 1 and 2, an example of a hearing assistance system according to the invention may comprise a transmission unit 10 comprising a microphone arrangement 17 for capturing audio signals from a voice of a speaker 11 using the transmission unit 10 and being adapted to transmit the audio signals as an RF signal via a wireless RF link 12 to a left ear hearing device 16B to be worn at or at least partially in the left ear of a hearing device user 13 and a right ear hearing device 16A to be worn at or at least partially in the right ear of the user 13, wherein both hearing devices 16A, 16B are adapted to stimulate the user's hearing and to receive an RF signal from the transmission unit 10 via the wireless RF link 12 and comprise a microphone arrangement 62 (see FIG. 5) for capturing audio signals from ambient sound. The hearing devices 16A, 16B also are adapted to communicate with each other via a binaural link 15. Further, the hearing devices 16A, 16B are able to estimate the azimuthal angular location of the transmission unit 10 and to process the audio signal received from the transmission unit 10 in a manner so as to create a hearing perception, when stimulating the user's hearing according to the processed audio signals, wherein the angular localization impression of the audio signals from the transmission unit 10 corresponds to the estimated azimuthal angular location of the transmission unit 10.

The hearing devices 16A and 16B are able to estimate the angular location of the transmission unit 10 in a manner which utilizes the fact that each hearing device 16A, 16B, on the one hand, receives the voice of the speaker 11 as an RF signal from the transmission unit 10 via the RF link 12 and, on the other hand, receives the voice of the speaker 11 as an acoustic (sound) signal 21 which is transformed into a corresponding audio signal by the microphone arrangement 62. By analyzing these two different audio signals in a binaural manner, a reliable and nevertheless relatively simple estimation of the angular location (illustrated in FIG. 2 by the angle "$\alpha$" which indicates the deviation of the viewing direction 23 of the hearing device user 13 (the "viewing direction" of the user is to be understood as the direction into which the user's nose is pointing) and the sound impingement direction 25) of the transmission unit 10 and the speaker 11 is performed.

Several audio parameters are determined locally by each hearing device 16A, 16B and then are exchanged via the binaural link 15 for determining the interaural difference of the respective parameter in order to estimate the angular location of the speaker 11/transmission unit 10 from these interaural differences. More in detail, each hearing device 16A, 16B determines a level of the RF signal, typically as an RSSI value, received by the respective hearing device. Interaural differences in the received RF signal level result from the absorption of RF signals by human tissue ("head shadow effect"), so that the interaural RF signal level difference is expected to increase with increasing deviation $\alpha$ of the direction 25 of the transmission unit 10 from the viewing direction 23 of the listener 13.

In addition, the level of the audio signal as captured by the microphone arrangement 62 of each hearing device 16A, 16B is determined, since also the interaural difference of the sound level ("inter aural level difference ILD") increases with increasing angle $\alpha$ due to absorption/reflection of sound waves by human tissue (since the level of the audio signal captured by the microphone arrangement 62 is proportional to the sound level, the interaural difference of the audio signal levels corresponds to the ILD).

Further, also the interaural phase difference (IPD) of the sound waves 21 received by the hearing devices 16A, 16B is determined by each hearing device 16A, 16B, wherein in at least one frequency band each hearing device 16A, 16B determines a phase difference between the audio signal received via the RF link 12 from the transmission unit 10 and the respective audio signal captured by the microphone arrangement 62 of the same hearing device 16A, 16B, with the interaural difference between the phase difference determined by the right ear hearing device and the phase difference determined by the left ear hearing device corresponding to the IPD. Herein, the audio signal received via the RF link 12 from the transmission unit 10 is taken as a reference, so that it is not necessary to exchange the audio signals captured by the microphone arrangement 62 of the two hearing devices 16A, 16B via the binaural link 15, but only a few measurement results. The IPD increases with increasing angle $\alpha$ due to the increasing interaural difference of the distance of the respective ear/hearing device to the speaker 11.

While in principle each of the three parameters interaural RF signal level difference, ILD and IPD alone might be used for a rough estimation of the angular location a of the speaker 11/transmission unit 10, an estimation taking into account all three of these parameters provides for a much more reliable result.

In order to enhance the reliability of the angular localization estimation, a coherence estimation (CE) may be conducted in each hearing device, wherein the degree of correlation between the audio signal received from the transmission unit 10 and the audio signal captured by the microphone arrangement 62 of the respective hearing device 16A, 16B is estimated in order to adjust the angular resolution of the estimation of the azimuthal angular location of the transmission unit 10 according to the estimated degree of correlation. In particular, a high degree of correlation indicates that there are "good" acoustical conditions (for example, low reverberation, low background noise, small distance between speaker 11 and listener 13, etc.), so that the audio signals captured by the hearing devices 16A, 16B are not significantly distorted compared to the demodulated audio signal received from the transmission unit 10 via the RF link 12. Accordingly, the angular resolution of the angular location estimation process may be increased with increasing estimated degree of correlation.

Since a meaningful estimation of the angular localization of the speaker 11/transmission unit 10 is possible only during times when the speaker 11 is speaking, the transmission unit 10 preferably comprises a voice activity detector (VAD) which provides an output indicating "voice on" (or "VAD true") or "voice off" (or "VAD false"), which output is transmitted to the hearing devices 16A, 16B via the RE link 12, so that the coherence estimation, the ILD determination and the IPD determination in the hearing devices 16A, 16B is carried out only during times when a "speech on" signal is received. By contrast, the RF signal level determination may be carried out also during times when the speaker 11 is not speaking, since an RF signal may be received via the RF link 12 also during times when the speaker 11 is not speaking.

Figure 6:
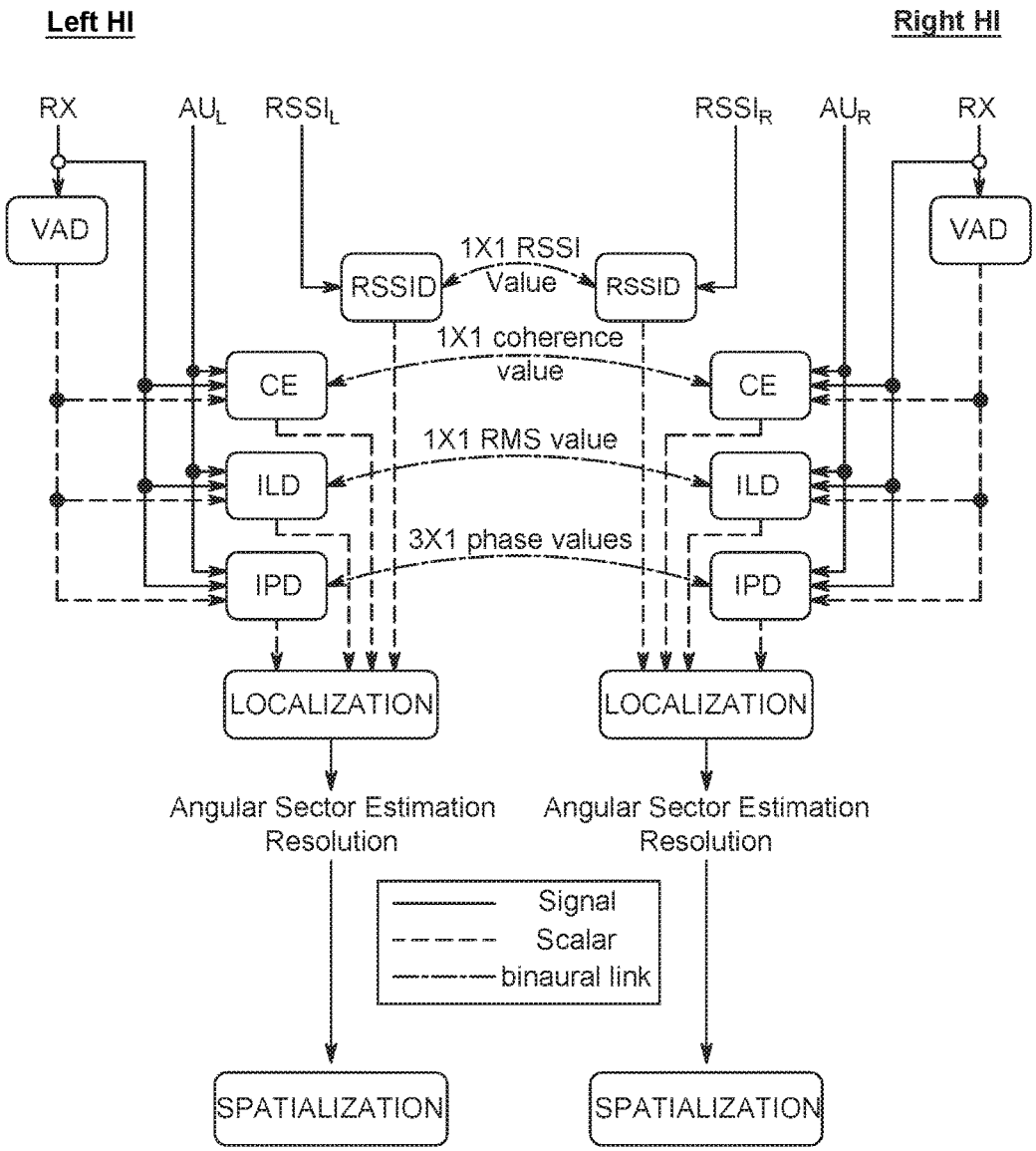
FIG. 6 is a block diagram of an example of the signal processing used by the present invention for estimating the angular localization of a wireless microphone.

A schematic diagram of an example of the angular localization estimation described so far is illustrated in FIG. 6, according to which example the hearing devices 16A, 16B exchange the following parameters via the binaural link 15: one RSSI value, one coherence estimation (CE) value, one RMS (root mean square) value indicative of the captured audio signal level, and at least one phase value (preferably, the IPD is determined in three frequency bands, so that one phase value is to be exchanged for each frequency band).

While the VAD preferably is provided in the transmission unit 10, it is also conceivable, but less preferred, to implement a VAD in each of the hearing devices, with voice activity then being detected from the demodulated audio signal received via the RF link 12.

According to the example of FIG. 6, the angular localization estimation process receives the following inputs: an RSSI value representative of the RE signal level (with "RSSIL" hereinafter designating the level of the radio signal captured by the left ear hearing device and "RSSIR" hereinafter designating the level of the radio signal captured by the right ear hearing device), the audio signal AU captured by the microphone arrangement 62 of the hearing device (with "AUL" hereinafter designating the audio signal AU captured by the left ear hearing device and "AUR" hereinafter designating the audio signal AU captured by the right ear hearing device), a demodulated audio signal (RX) received via the RE link 12 and the VAD status received via the RF link 12 (alternatively, as mentioned above, the VAD status may be determined in both left and right hearing devices by analyzing the demodulated audio signal).

The output of the angular localization estimation process is, for each hearing device, an angular sector in which the transmission unit 10/speaker 11 is most likely to be located, which information then is used as an input to a spatialization processing of the demodulated audio signal.

Hereinafter, an example of a transmission unit 10 and an example of a hearing device 16 will be described in more detail, followed by a detailed description of various steps of the angular localization estimation process.

Figure 4:
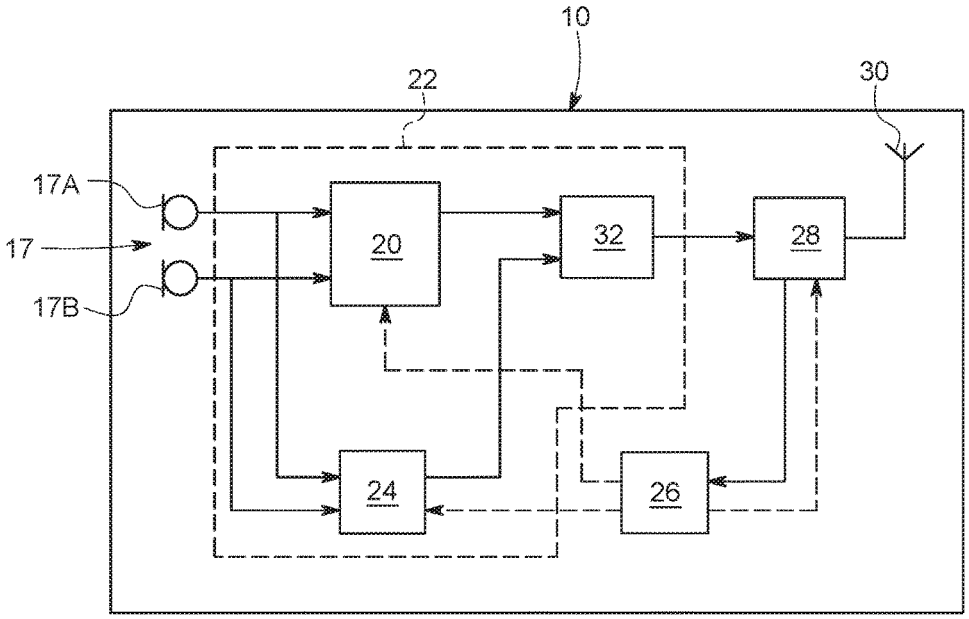
FIG. 4 is a schematic example of a block diagram of an audio transmission device of a hearing assistance system according to the invention.

An example of a transmission unit 10 is shown in FIG. 4, comprising a microphone arrangement 17 for capturing audio signals from the voice of a speaker 11, an audio signal processing unit 20 for processing the captured audio signals, a digital transmitter 28 and an antenna 30 for transmitting the processing audio signals as an audio stream 19 consisting of audio data packets to the hearing devices 16A, 16B. The audio stream 19 forms part of the digital audio link 12 established between the transmission unit 10 and the hearing devices 16A, 16B. The transmission unit 10 may include additional components, such as unit 24 comprising a voice activity detector (VAD). The audio signal processing unit 20 and such additional components may be implemented by a digital signal processor (DSP) indicated at 22. In addition, the transmission unit 10 also may comprise a microcontroller 26 acting on the DSP 22 and the transmitter 28. The microcontroller 26 may be omitted in case that the DSP 22 is able to take over the function of the microcontroller 26. Preferably, the microphone arrangement 17 comprises at least two spaced-apart microphones 17A, 17B, the audio signals of which may be used in the audio signal processing unit 20 for acoustic beamforming in order to provide the microphone arrangement 17 with a directional characteristic. Alternatively, a single microphone with multiple sound ports or some suitable combination thereof may be used as well.

The VAD unit 24 uses the audio signals from the microphone arrangement 17 as an input in order to determine the times when the person 11 using the respective transmission unit 10 is speaking, i.e. the VAD unit 24 determines whether there is a speech signal having a level above a speech level threshold value. The VAD function may be based on a combinatory logic-based procedure between conditions on the energy computed in two subbands (e.g. 100-600 Hz and 300-1000 Hz). The validation threshold may be such that only the voiced sounds (mainly vowels) are kept (this is because localization is performed on low-frequency speech signal in the algorithm, in order to reach a higher accuracy).

The output of the VAD unit 24 may consists in a binary value which is true when the input sound can be considered as speech and false otherwise.

An appropriate output signal of the unit 24 may be transmitted via the wireless link 12. To this end, a unit 32 may be provided which serves to generate a digital signal merging a potential audio signal from the processing unit 20 and data generated by the unit 24, which digital signal is supplied to the transmitter 28. In practice, the digital transmitter 28 is designed as a transceiver, so that it cannot only transmit data from the transmission unit 10 to the hearing devices 16A, 16B but also receive data and commands sent from other devices in a network. The transceiver 28 and the antenna 30 may form part of a wireless network interface.

According to one embodiment, the transmission unit 10 may be designed as a wireless microphone to be worn by the respective speaker 11 around the speaker's neck or as a lapel microphone or in the speaker's hand. According to an alternative embodiment, the transmission unit 10 may be adapted to be worn by the respective speaker 11 at the speaker's ears such as a wireless earbud or a headset. According to another embodiment, the transmission unit 10 may form part of an ear-level hearing device, such as a hearing aid.

Figure 5:
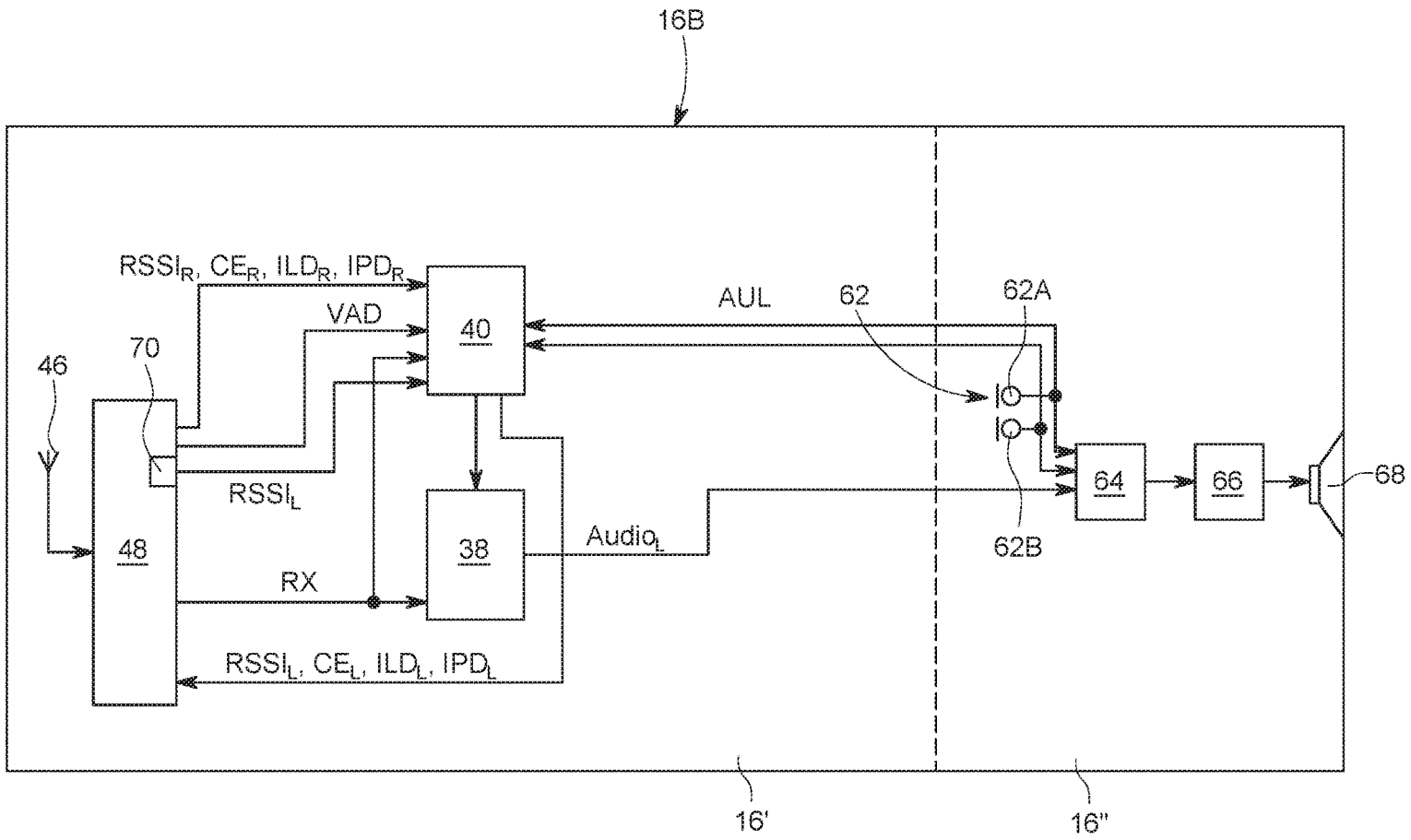
FIG. 5 is a schematic block diagram of an example of a hearing device of a hearing assistance system according to the invention.

An example of the signal paths in a left ear hearing device 16B is shown in FIG. 5, wherein a transceiver 48 receives the RF signal transmitted from the transmission unit 10 via the digital link 12, i.e. it receives and demodulates the audio signal stream 19 transmitted from the transmission units 10 into a demodulated audio signal RX which is supplied both to an audio signal processing unit 38 and to an angular localization estimation unit 40. The hearing device 16B also comprises a microphone arrangement 62 comprising at least one—preferably two—microphones for capturing audio signal ambient sound impinging on the left ear of the listener 13, such as the acoustic voice signal 21 from the speaker 11.

The received RF signal is also supplied to a signal strength analyser unit 70 which determines the RSSI value of the RF signal, which RSSI value is supplied to the angular localization estimation unit 40.

The transceiver 48 receives via the RF link 12 also a VAD signal from the transmission unit 10, indicating "voice on" or "voice off", which is supplied to the angular localization estimation unit 40.

Further, the transceiver 48 receives via the binaural link certain parameter values from the right ear hearing device 16A, as mentioned with regard to FIG. 6, in order to supply these parameter values to the angular localization estimation unit 40; the parameter values are (1) the RSSI value $RSSI_R$ corresponding to the level of the RF signal of the RF link 12 as received by the right ear hearing device 16A, (2) the level of the audio signal as captured by the microphone 62 of the right ear hearing device 16A, (3) a value indicative of the phase difference of the audio signal as captured by the microphone 62 of the right ear hearing device 16A with regard to the demodulated audio signal as received by right ear hearing device 16A via the RF link 12 from the transmission unit 10, with a separate value being determined for each frequency band in which the phase difference is determined, and (4) a CE value indicative of the correlation of the audio signal as captured by the microphone 62 of the right ear hearing device 16A and the demodulated audio signal as received by right ear hearing device 16A via the RF link 12 from the transmission unit 10.

The RF link 12 and the binaural link 15 may use the same wireless interface (formed by the antenna 46 and the transceiver 48), shown in FIG. 5, or they may use two separate wireless interfaces (this variant is not shown in FIG. 5). Finally, the audio signal as captured by the local microphone arrangement 62 is supplied to the angular localization estimation unit 40.

The above parameter values (1) to (4) are also determined, by the angular localization estimation unit 40, for the left ear hearing device 16B and are supplied to the transceiver for being transmitted via the binaural link 15 to the right ear hearing device 16A for use in an angular localization estimation unit of the right ear hearing device 16A.

The angular localization estimation unit 40 outputs a value indicative of the most likely angular localization of the speaker 11/transmission unit 10, typically corresponding to an azimuthal sector, which value is supplied to the audio signal processing unit 38 action as a "spatialization unit" for processing, by adjusting signal level and/or signal delay (with possibly different levels and delays in the different audio bands (HRTF), the audio signal received via the RF link 12 in a manner that the listener 13, when stimulated simultaneously with the audio signal as processed by the audio signal processing unit 38 of the left ear hearing device 16B and with the audio signal as processed by the respective audio signal processing unit of the right ear hearing device 16A, perceives the audio signal received via the RF link 12, as origination from the angular location estimated by the angular localization estimation unit 40. In other words, the hearing devices 16A, 16B cooperate to generate a stereo signal, with the right channel being generated by the right ear hearing device 16A and with the left channel being generated by the left ear hearing device 16B.

The hearing devices 16A, 16B comprise an audio signal processing unit 64 for processing the audio signal captured by the microphone arrangement 62 and combining it with the audio signals from the unit 38, a power amplifier 66 for amplifying the output of the unit 64, and a loudspeaker 68 for converting the amplified signals into sound.

According to one example, the hearing devices 16A, 16B may be designed as hearing aids, such as BTE, ITE or CIC hearing aids, or as cochlear implants, with the RF signal receiver functionality being integrated with the hearing aid. According to an alternative example, the RF signal receiver functionality, including the angular localization estimation unit 40 and the spatialization unit 38, may be implemented in a receiver unit (indicated at 16' in FIG. 5) which is to be connected to a hearing aid (indicated at 16" in FIG. 5) including the local microphone arrangement 62; according to a variant, only the RF signal receiver functionality may be implemented in a separated receiver unit, whereas the angular localization estimation unit 40 and the spatialization unit 38 from part of the hearing aid to which the receiver unit is connected to.

Typically, the carrier frequencies of the RF signals are above 1 GHz. In particular, at frequencies above 1 GHz the attenuation/shadowing by the user's head is relatively strong. Preferably, the digital audio link 12 is established at a carrier-frequency in the 2.4 GHz ISM band. Alternatively, the digital audio link 12 may be established at carrier-frequencies in the 868 MHz 915, or 5800 MHz bands, or in as an UWB-link in the 6-10 GHz region.

Depending on the acoustical conditions (reverberation, background noise, distance between speaker and listener . . . ), the audio signals from the earpieces can be significantly distorted compared to the demodulated audio signal from the transmission unit 10. Since this has a prominent effect on the localization accuracy, the spatial resolution (i.e. number of angular sectors) may be automatically adapted depending on the environment.

As already mentioned above, the CE is used to estimate the resemblance of the audio signal received via the RF link ("RX signal") and the audio signal captured by the hearing device microphone "AU signal". This can be done, for example, by computing the so-called "coherence" as follows:

$$C(k) = \max_d \frac{|E\{AU^{k\to k+4}(n)RX^{k\to k+4}(n+d)\}|}{\sqrt{E\{AU^{k\to k+4}(n)^2\}E\{RX^{k\to k+4}(n)^2\}}}$$

for $k = 1, 6, 11 \ldots$ , where E{ } denotes the mathematical mean, d is the varying delay (in samples) applied for the computation of the cross-correlation function (numerator), $RX^{k\to k+4}$ is the demodulated RX signal accumulated over typically five 128-sample frames, and AU denotes the signal coming from the microphone 62 of the hearing device (hereinafter also referred to as "earpiece").

The signals are accumulated over typically 5 frames in order to take into consideration the delay that occurs between the demodulated RX and the AU signals from the earpieces. The RX signal delay is due to the processing and transmission latency in the hardware and is typically a constant value. The AU signal delay is made of a constant component (the audio processing latency in the hardware and a variable component corresponding to the acoustical time-of-flight (3 ms to 33 ms for speaker-to-listener distance between 1 m and 10 m). If only one 128-sample frame was considered for the computation of the coherence, it may happen that the two current RX and AU frames do not share any common samples, resulting in a very low coherence value even though the acoustical conditions would be fine. In order to reduce the computational cost of this block, more than one accumulated frame may be down-sampled. Preferably, no anti-aliasing filter is applied before down-sampling, so that the computational cost remains as low as possible. It was found that the consequences of the aliasing are limited. Obviously, the buffers are processed only if their content is voiced speech (information carried by the VAD signal).

The local computed coherence may be smoothed with a moving average filter that requires the storage of several previous coherence values. The output is theoretically between 1 (identical signals) and 0 (completely decorrelated signals). In practice, the outputted values have been found to be between 0.6 and 0.1, which is mainly due to the down-sampling operation that reduces the coherence range. A threshold $C_{HIGH}$ has been defined such that:

$$\text{Resolution} = \begin{cases} 5 \text{ sectors if } C > C_{HIGH} \\ 3 \text{ sectors otherwise} \end{cases}.$$

Another threshold $C_{LOW}$ has been set so that the localization is reset if $C<C_{LOW}$, i.e. it is expected that the acoustical conditions are too bad for the algorithm to work properly. In what follows, the resolution is set to 5 (sectors) for the algorithm description.

Thus, the range of possible azimuthal angular locations may be divided into a plurality of azimuthal sectors, wherein the number of sectors is increased with increasing estimated degree of correlation; the estimation of the azimuthal angular location of the transmission unit may be interrupted as long as the estimated degree of correlation is below a first threshold; in particular, the estimation of the azimuthal angular location of the transmission unit may consist of three sectors as long as the estimated degree of correlation is above the first threshold and below a second threshold and consists of five sectors as long as the estimated degree of correlation is above the second threshold.

As already mentioned above, the angular localization estimation may utilize an estimation of the sound pressure level difference between both right ear and left ear audio signals, also called ILD, which takes as input the AU signal from the left ear hearing device ("AUL signal") (or the AU signal from the right ear hearing device ("AUR signal")), and the output of the VAD. The ILD localization process is in essence much less precise than the IPD process described later. Therefore the output may be limited to a 3-state flag indicating the estimated side of the speaker relative to the listener (1: source on the left, −1: source on the right, 0: uncertain side); i.e. the angular localization estimation in essence uses only 3 sectors.

The block procedure may be divided into six main parts:

(1) VAD checking: If the frame contains voiced speech, processing starts, otherwise the system waits until voice activity is detected.

(2) AU signals filtering (e.g. kHz band-pass filter having a lower limit (cut-off frequency) of 1 kHz to 2.5 kHz and an upper limit (cut-off frequency) of 3.5 kHz to 6 kHz, with initial conditions given by the previous frame). This bandwidth may be chosen since it provides the highest ILD range with the lowest variations.

(3) Energy accumulation, e.g. for the left signals:

$$E_L(k) = E_L(k-1) + \sum_{n=1}^{128} |AU_L^k(n)|^2,$$

where $AU_L^k$ denotes the left signal of the frame k, and $E_L$ is the energy.

(4) Exchange of the $E_L$ and $E_R$ values through the binaural link 15.

(5) ILD computation:

$$ILD(k) = 10\log\left(\frac{E_L(k)}{E_R(k)}\right).$$

(6) Side determination:

$$\text{side}(k) = \begin{cases} 1 & \text{if } ILD(k) > ut \\ -1 & \text{if } ILD(k) < ut \\ 0 & \text{otherwise} \end{cases},$$

where ut denotes the uncertainty threshold (typically 3 dB).

Steps (5) and (6) are not launched on each frame; the energy accumulation is performed on a certain time period (typically 100 ms, representing the best tradeoff between accuracy and reactivity). The ILD value and side are updated at the corresponding frequency.

The interaural RF signal level difference ("RSSID") is a cue similar to the ILD but in the radio-frequency domain (e.g. around 2.4 GHz). The strength of each data packet (e.g. a 4 ms packet) received at the earpiece antenna 46 is evaluated and transmitted to the algorithm on the left and right sides. The RSSID is a relatively noisy cue that typically requires to be smoothed in order to become useful. Like the ILD, it typically cannot be used to estimate a fine localization, therefore the output of the RSSID block usually provides a 3-state flag indicating the estimated side of the speaker relative to the listener (1: source on the left, −1: source on the right, 0: uncertain side), corresponding to three different angular sectors.

An autoregressive filter may be applied for the smoothing, which avoids storing all the previous RSSI differences (the ILD requires the computation of 10 log(El/Ek), whereby the RSSI readout are already in dBm (logarithmic format), therefore the simple difference is taken) to compute the current one, only the previous output has to be fed back:

$$\mathrm{RSSID}(k)=\lambda\mathrm{RSSID}(k-1)+(1-\lambda)(\mathrm{RSSI}_L-\mathrm{RSSI}_R),$$

where λ is the so-called forgetting factor. Given a certain wanted number of previous accumulated values N, λ is derived as follows:

$$\lambda=\frac{N-1}{N}.$$

A typical value of 0.95 (N=20 values) has been found to yield an adequate tradeoff between accuracy and reactivity. As for the ILD, the side is determined according to an uncertainty threshold:

$$\mathrm{side}(k)=\begin{cases}1 & \text{if } RSSID(k)>ut\\ -1 & \text{if } RSSID(k)<ut\\ 0 & \text{otherwise}\end{cases},$$

where ut denotes the uncertainty threshold (typ. 5 dB).

The system uses a radio frequency hopping scheme. The RSSI readout might be different from one RF channel to the others, due to the frequency response of the TX and RX antennas, to multipath effects, to the filtering, to interferences, etc. Therefore a more reliable RSSI result may be obtained by using a small database of the RSSI on the different channels, and compare the variation of the RSSI over time on a per-channel basis. This would reduce the variations due to the above mentioned phenomena, at the cost of a slightly more complex RSSI acquisition and storage, requiring more RAM.

Figure 7:
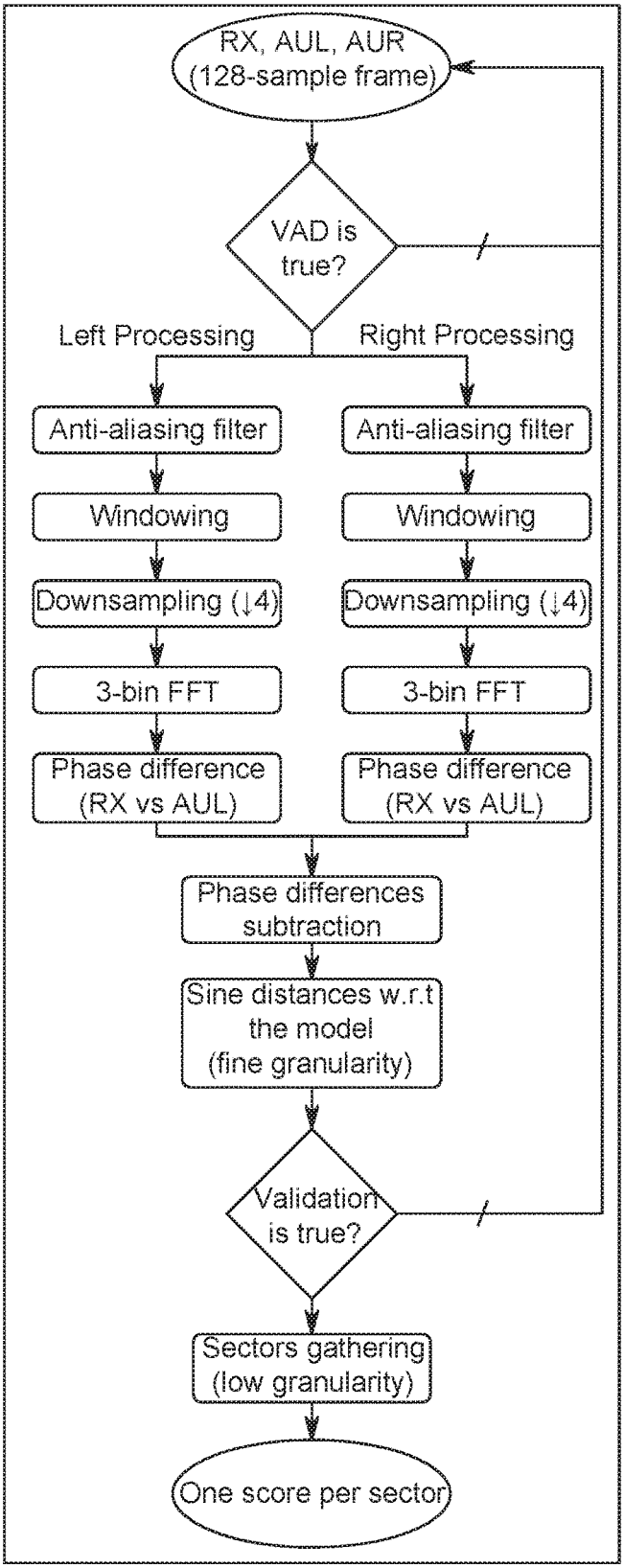
FIG. 7 is an example of a flow chart of the IPD block of FIG. 6.

The IPD block estimates the interaural phase difference between the left and right audio signals on some specific frequency components. The IPD is the frequency representation of the Interaural Time Difference ("ITD"), another localization cue used by the human auditory system. It takes as input the respective AU signal and the RX signal, which serves as phase reference. The IPD is only processed on audio frames containing useful information (i.e. when "VAD true"/"voice on"). An example of a flow chart of the process is illustrated in FIG. 7.

Since the IPD is more robust at low frequency (according to the duplex theory, by Lord Rayleigh), the signals may be decimated by a factor of 4 to reduce the required computing power. FFT components of 3 bins are computed, corresponding to frequencies equal to 250 Hz, 375 Hz and 500 Hz (showing highest IPD range with lowest variations). The phase is then extracted and the RX vs. AUL/AUR phase differences (called $\varphi_L$ and $\varphi_R$ in the following) are computed for both sides, i.e.:

$$\begin{cases}\varphi_L(\omega_{1,2,3})=\angle\mathfrak{F}\{RX\}(\omega_{1,2,3})-\angle\mathfrak{F}\{AU_L\}(\omega_{1,2,3})\\ \varphi_R(\omega_{1,2,3})=\angle\mathfrak{F}\{RX\}(\omega_{1,2,3})-\angle\mathfrak{F}\{AU_R\}(\omega_{1,2,3})\end{cases},$$

where $\Im\{.\}$ denotes the Fourier Transform and $\omega_{1,2,3}$ the three considered frequencies.

Transmitting $\varphi_L$ and $\varphi_R$ from one side to the other and subtracting them, the IPD can be recovered:

$$\begin{aligned}\varphi_R(\omega_{1,2,3})-\varphi_L(\omega_{1,2,3})&=\angle\mathfrak{F}\{AU_L\}(\omega_{1,2,3})-\angle\mathfrak{F}\{AU_R\}(\omega_{1,2,3})\\&=\overline{IPD}(\omega_{1,2,3}).\end{aligned}$$

A N×3 reference matrix containing theoretical values of IPD for a set of N incidence directions (for example, if a resolution of 10 degrees is chosen, the N=18 for the half plane) and the 3 different frequency bins $\theta_{1,2\ \ldots\ N}$ is computed from the so-called sine law:

$$IPD(\omega_{1,2,3},\theta_{1,2\ \ldots\ N})=\frac{a\omega_{1,2,3}}{c}\sin\theta_{1,2\ \ldots\ N},$$

where a is proportional to the distance between the two hearing devices (head size) and c is the sound celerity in air.

The angular deviation d between both the observed and theoretical IPD is assessed using a sine square function, as follows:

$$d(\theta_{1,2\ \ldots\ N})=\sum_{\omega_{1,2,3}}\sin^2(\overline{IPD}(\omega)-IPD(\omega,\theta_{1,2\ \ldots\ N})),$$

with d ∈ [0; 3], a lower value for d means a higher degree of matching with the model.

The current frame is used for localization only if the minimal deviation over the set of tested azimuth is below a threshold δ (validation step):

$$\min_{\theta_{1,2\ \ldots\ N}} d(\theta)\le\delta.$$

The typical value of δ is 0.8, providing an adequate tradeoff between accuracy and reactivity.

Finally, the deviations are accumulated into azimuthal sectors (5 or 3 sectors) for the corresponding azimuth angles:

$$D(i)=\frac{1}{s(i)}\sum_{\theta\ge\theta_i^{low}}^{\theta<\theta_i^{high}}d(\theta)\ \text{for}\ i=1\ \ldots\ 5,$$

where D(i) is the accumulated error of the sector i, $\theta_i^{low}$, $\theta_i^{high}$ are the low and high angular boundaries of the sector i and s(i) is the size of the sector i (in terms of discrete tested angle); while in the example i=1 . . . 5 denotes a 5 sectors resolution, i=1 . . . 3 would denote a 3 sectors resolution.

The output of the IPD block is the vector D, which is set to 0 if the VAD is off or if the validation step is not fulfilled. Thus, the frame will be ignored by the localization block.

The localization block performs localization using the side information from the ILD and RSSID blocks and the deviation vector from the IPD block. The output of the localization block is the most likely sector estimated from the current azimuthal angular location of the speaker relative to the listener.

For each incoming non-zero deviation vector, the deviations are translated into probabilities of each sector with the following relations:

$$p_D(i) = \frac{3 - D(i)}{\sum_{j=1}^{j=5} D(j)} \text{ for } i = 1 \ldots 5,$$

where $p_D$ is a probability between 0 and 1 such that:

$$\sum_{i=1}^{i=5} p_D(i) = 1$$

A moving average filter is then applied, taking the weighted average over the K previous probabilities in each sector (typically K=15 frames) in order to get a stable output. $\tilde{p}_D$ denotes the time-averaged probabilities.

The time-averaged probabilities are then weighted depending on the side information from the ILD and RSSID blocks:

$$\tilde{P}_D(i) = w_{ILD}(i) \times w_{RSSID}(i) \times \tilde{p}_D(i),$$

where the weights $w_{ILD}$ and $w_{RSSID}$ depends on the side information. For the ILD weights $w_{ILD}$, three cases must be distinguished:

If the side information from the ILD is 1, the probabilities of the left sectors are increased while the probabilities of the right sectors are attenuated:

$$w_{ILD}(i) = \begin{cases} \frac{1}{\gamma} & \text{for } i = 1, 2 \text{ (right sectors)} \\ 1 & \text{for } i = 3 \text{ (central sector)} \\ \gamma & \text{for } i = 4, 5 \text{ (left sectors)} \end{cases}$$

The typical value of γ is 3.

If the side information from the ILD is −1, the probabilities of the right sectors are increased while the probabilities of the left sectors are attenuated:

$$w_{ILD}(i) = \begin{cases} \gamma & \text{for } i = 1, 2 \text{ (right sectors)} \\ 1 & \text{for } i = 3 \text{ (central sector)} \\ \frac{1}{\gamma} & \text{for } i = 4, 5 \text{ (left sectors)} \end{cases},$$

If the information side from the ILD is 0, no sector is favored:

The same cases hold for the RSSID weights $w_{RSSID}$. Thus, the weights of the ILD and RSSID cancel each other in case of conflicting cues. It is to be noted that after this weighting operation, one should not speak about "probabilities" anymore, since the sum does not equal 1 (this is because weights cannot be formally applied on probabilities as it is done here). Nevertheless, the name "probabilities" will be kept hereinafter for understanding reasons.

A tracking model based on a Markovian-inspired network may be used in order to manage the motion of the estimation between the 5 sectors. The change from one sector to another is governed by transition probabilities that are gathered in a 5×5 transition matrix. The probability to stay in a particular sector X is denoted $p_{XX}$, while the probability to go from a sector X to a sector Y is $p_{XY}$. The transition probabilities may be defined empirically; several set of probabilities may be tested in order to provide the best tradeoff between accuracy and reactivity. The transition probabilities are such that:

$$\sum_{Y=1}^{Y=5} p_{XY} = 1 \text{ for } X = 1 \ldots 5.$$

Let S(k−1) be the sector of the frame k−1. At the iteration k, the probability of the sector t knowing that the previous sector is S(k−1) is:

$$P(i) = \tilde{P}_D(i) \times p_{s(k-1)i} \text{ for } i = 1 \ldots 5.$$

Thus, the current sector S(k) may be computed such that:

$$S(k) = \underset{i}{\operatorname{argmax}} P(i).$$

It is to be noted that the model is initialized in the sector 3 (frontal sector).

This example of azimuthal angular localization estimation may be described in a more generalized manner as follows:

The range of possible azimuthal angular locations may be divided into a plurality of azimuthal sectors and, at a time, one of the sectors is identified as the estimated azimuthal angular location of the transmission unit. Based on the deviation of the interaural difference of the determined phase differences from a model value for each sector, a probability is assigned to each azimuthal sector and that probabilities are weighed based on the respective interaural difference of the level of the received RF signals and the level of the captured audio signals, wherein the azimuthal sector having the largest weighted probability is selected as the estimated azimuthal angular location of the transmission unit. Typically, there are five azimuthal sectors, namely two right azimuthal sectors R1, R2, two left azimuthal sectors L1, L2, and a central azimuthal sector C, see also FIG. 1.

Further, the possible azimuthal angular locations are divided into a plurality of weighting sectors (typically, are three weighting sectors, namely a right side weighting sector, a left side weighting sector and a central weighting sector), and one of the weighting sectors is selected based on the determined interaural difference of the level of the received RF signals and/or the level of the captured audio signals. The selected weighting sector is that one of the weighting sectors which fits best with an azimuthal angular location estimated based on the determined interaural difference of the level of the received RF signals and/or the level of the captured audio signals. The selection of the weighting sector corresponds to the (additional) side information (e.g. the side information values −1 ("right side weighting sector"); 0 ("central weighting sector") and 1 ("left side weighting sector") in the example mentioned above) obtained from the determined interaural difference of the level of the received RF signals and/or the level of the captured audio signals. Each of such weighting sectors/side information values is associated with distinct set of weights to be applied to the azimuthal sectors. More in detail, in the example mentioned above, if the right side weighting sector is selected (side information value −1), a weight of 3 is applied to the two right azimuthal sectors R1, R2; a weight of 1 is applied to the central azimuthal sector C, and a weight of ⅓ is applied to the two left azimuthal sectors L1, L2), i.e. the set of weights is (3; 1; ⅓); if the if the central weighting sector is selected (side information value 0), the set of weights is (1; 1; 1); and if the left side weighting sector is selected (side information value 1), the set of weights is {⅓; 1; 3}. In general, the set of weights associated to a certain weighting sector/side information value is such that the weight of the azimuthal sectors falling within (or close to) that weighting sector is increased relative to the azimuthal sectors outside (or remote from) that weighting sector.

In particular, a first weighting sector (or side information value) may be selected based on the determined interaural difference of the level of the received RF signals, and a second weighting sector (or side information value) may be selected separately based on the determined interaural difference of the level of the captured audio signals (usually, for "good" operation/measurement conditions, the side information/selected weighting sector obtained from the determined interaural difference of the level of the received RF signals and the side information/selected weighting sector obtained from the determined interaural difference of the level of the captured audio signals will be equal)

By using the directional properties of a microphone arrangement comprising two spaced apart microphones situated on one hearing device, it may be possible to detect if the speaker is in front or in the back of the listener. For example, by setting the two microphones of a BTE hearing aid in cardioid mode toward front, respectively back, one could determine in which case the level is the highest and therefore select the correct solution. However, in certain situations it might be quite difficult to determine whether the talker is in front or in the back, such as in noisy situations, when the room is very reflective for audio waves, or when the speaker is far away from the listener. In the case where the front/back determination is activated, then the number of sector used for the localization is typically doubled, compared to the case where only localization in the front plane is done.

During times when the VAD is "off", i.e. no speech is detected, the weight of audio ILD is virtually 1, but a rough localization estimation remains possible based on the interaural RF signal level (e.g. RSSI) difference. So when the VAD becomes "on" again, the localization estimation may be reinitialized based on the RSSI values only, which fastens the localization estimation process, compared to the case no RSSI values are available.

If the VAD is "off" for a long time, e.g. 5 s, then there is a high chance that the listening situation has changed (e.g. head rotation at the listener, moving of the speaker, etc.). Therefore the localization estimation and spatialization may be reset to "normal", i.e. front direction. If the RSSI values are stable over the time, this means that the situation is stable, therefore such reset would not be required and can be postponed.

Once the sector in which the speaker is positioned has been determined, the RX signal is processed to provide a different audio stream (i.e. stereo stream) at left and right sides in a manner that the desired spatialization effect is achieved.

To spatialize the RX sound, an HRTF (Head Related transfer Function) may be applied to the RX signal. One HRTF per sector is required. The corresponding HRTF may be simply applied as filtering function to the incoming audio stream. However, in order to avoid that transitions between sectors are too abrupt (i.e. audible), an interpolation of the HRTF of 2 adjacent sectors may be done while sector is being changed, thereby enabling a smooth transition between sectors.

In order to get HRTF filtering with the lowest dynamic (both to consider the reduced dynamic range of hearing impaired subject and to reduce filter order if possible), a dynamic compression may be applied on the HRTF database. Such filtering works like a limiter, i.e. all the gains greater than a fixed threshold are clipped, for each frequency bin. The same applies for gains below another fixed threshold. So the gain values for any frequency bin are kept within a limited range. This processing may be done in a binaural way in order to preserve the ILD as best as possible.

In order to minimize the size of the HRTF database, a minimal phase representation may be used. This well-known algorithm by Oppenheim is a tool used to get an impulse response with the maximum energy at its beginning and helps to reduce filter orders.

Figure 3:
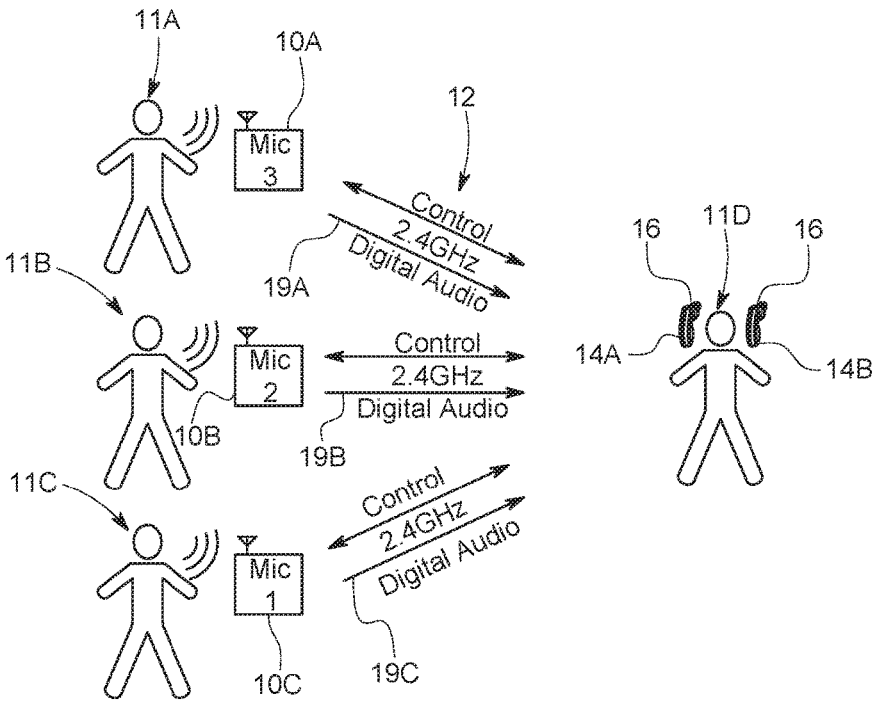
FIG. 3 is an illustration of a use situation of an example of a hearing assistance system according to the invention comprising a plurality of transmission devices.

While the examples described so far relate to hearing assistance systems comprising a single transmission unit, the hearing assistance systems according to the invention may comprises several transmitting units used by different speakers. An example of a system comprising three transmission units 10 (which are individually labelled 10A, 10B, 10C) and two hearing devices 16A, 16B worn by a hearing-impaired listener 13 is schematically shown in FIG. 3. The hearing devices 16A, 16B may receive audio signals from each of the transmission units 10A, 10B, 10C in FIG. 3, the audio stream from the transmission unit 10A is labelled 19A, the audio stream from the transmission unit 10B is labelled 19B, etc.).

There are several options of how to handle the audio signal transmission/reception.

Preferably, the transmission units 10A, 10B, 10C form a multi-talker network ("MTN"), wherein the currently active speaker 11A, 11B, 11C is localized and spatialized. Implementing a talker change detector would fasten the system's transition from one talker to the other, so that one can avoid that the system reacts as if the talker would virtually move very fast from one location to the other (which is also in contradiction with what the Markov model for tracking allows). In particular, by detecting the change in transmission unit in a MTN one could go one step further and memorize the present sector of each transmission unit and initialize the probability matrix to the last known sector. This would even fasten the transition from one speaker to the other in a more natural way.

If one detects that several talkers have moved from one sector to another, this might be due to the fact that the listener turned his head. In this case all the known positions of the different transmitters could be moved by the same angle, so that when any of those speaker talks again, its initial position is guessed best.

Rather than abruptly switching from one talker to the other, several audio streams may be provided simultaneously through the radio link to the hearing devices. If enough processing power is available in the hearing aid, it would be possible to localize and spatialize the audio stream of each of the talkers in parallel, which would improve the user experience. The only limitations are the number of reference audio streams available (through RF) and the available processing power and memory in the hearing devices.

Each hearing device may comprise a hearing instrument and a receiver unit which is mechanically and electrically connected to the hearing instrument or is integrated within the hearing instrument. The hearing instrument may be a hearing aid or an auditory prosthesis (such as a CI).

The invention claimed is:

1. A system for providing hearing assistance to a user, comprising:

a left ear hearing device and a right ear hearing device, each hearing device adapted to provide audio and to receive a radio frequency (RF) signal from a transmission unit via a wireless RF link, wherein each hearing device comprises a microphone, wherein the hearing devices are adapted to communicate with each other via a binaural link, wherein the hearing devices are adapted to estimate an angular location of the transmission unit by determining a level of the RF signal received by the left ear hearing device and a level of the RF signal received by the right ear hearing device, wherein the hearing devices are configured to determine a level of the audio signal captured by the microphone of the left hearing device and a level of the audio signal captured by the microphone of the right hearing device, wherein the hearing devices are configured to determine a phase difference between the RF signal received by the left ear hearing device and the audio signal captured by the microphone of the left ear hearing device and a phase difference between the RF signal received by the right ear hearing device and the audio signal captured by the microphone of the right ear hearing device, wherein the hearing devices are configured to exchange, via the binaural link, data representative of the determined level of the RF signal, the determined level of the audio signal and the determined phase difference between the hearing devices, wherein the hearing devices are configured to estimate, separately in each of the hearing devices and based on the respective interaural differences of said exchanged data, an azimuthal angular location of the transmission unit, and wherein each hearing device is adapted to process the audio signal received from the transmission unit via the RF wireless link to create a hearing perception when providing audio.

2. The system of claim 1, wherein the hearing devices are adapted to divide a range of possible azimuthal angular locations into a plurality of azimuthal sectors and to identify one of the sectors as the estimated azimuthal angular location of the transmission unit.

3. The system of claim 2, wherein the hearing devices are adapted to assign to each azimuthal sector, based on the deviation of the interaural difference of the determined phase differences from a model value for each sector, a probability and to weight these probabilities based on the respective interaural difference of the level of the received RF signals and/or the level of the captured audio signals, wherein the azimuthal sector having thy: largest weighted probability is selected as the estimated azimuthal angular location of the transmission unit.

4. The system of claim 3, wherein the hearing devices are adapted to divide the possible azimuthal angular locations into a plurality of weighting sectors, with a certain set of weights being associated with each weighting sector, and to select one of the weighting sectors based on the determined interaural difference of the level of the received RF signals and/or the level of the captured audio signals in order to apply the associated set of weights to the azimuthal sectors, wherein the selected weighting sector is that one of the weighting sectors which fits best with an azimuthal angular location estimated based on the determined interaural difference of the level of the received RF signals and/or the level of the captured audio signals.

5. The system of claim 4, wherein a first weighting sector is selected based on the determined interaural difference of the level of the received RF signals and a second weighting sector is selected separately based on the determined interaural difference of the level of the captured audio signals, with the both respective set of weights associated with the first selected weighting sector and the respective set of weights associated with the second selected weighting sector being applied to the azimuthal sectors.

6. The system of claim 4, wherein there are three weighting sectors, namely a right weighting sector, a left weighting sector and a central weighting sector.

7. The system of claim 2, wherein there are two right azimuthal sectors, two left azimuthal sectors and a central azimuthal sector.

8. The system of claim 1, wherein said phase difference is determined in at least two different frequency bands.

9. The system of claim 1, wherein the hearing devices are adapted to determine the RF signal levels as received signal strength indicator (RSSI) levels.

10. The system of claim 9, wherein the heating devices are adapted to apply an autoregressive filter to smooth the RSSI levels.

11. The system of claim 10, wherein the hearing devices are adapted to use at least two subsequently measured RSSI levels to smooth the RSSI levels.

12. The system of claim 1, wherein hearing devices are adapted to determine the RF signal levels separately for a plurality of frequency channels, with the respective interaural RF signal level difference being determined separately for each frequency channel.

13. The system of claim 1, wherein the captured audio signals are bandpass filtered for determining the level of the captured audio signals.

14. The system of claim 13, wherein the lower cut-off frequency of the bandpass filtering is from 1 kHz to 2.5 kHz and the upper cut-off frequency is from 3.5 kHz to 6 kHz.

15. The system of claim 1, wherein the system is adapted to detect voice activity when the speaker using the transmission unit is speaking, and wherein each hearing device is adapted to determine the level of the audio signal captured by the microphone of the respective hearing device, the level of the RF signal received by the respective hearing device and/or the phase difference between the audio signal received via the RF link and the audio signal captured by the microphone of the respective hearing device only during times when voice activity is detected by the system.

16. The system of claim 15, wherein the transmission unit comprises a voice activity detector for detecting voice activity by analyzing the audio signal captured by the microphone of the transmission unit and is adapted to transmit an output signal of the voice activity detector representative of the detected voice activity via the wireless link to thy: hearing devices.

17. The system of claim 15, wherein each of the hearing devices comprises a voice activity detector for detecting voice activity by analyzing the audio signal received via the RF link from the transmission unit.

18. The system of claim 15, wherein the hearing devices are adapted to obtain, during times when no voice activity is detected, a rough estimation of the azimuthal angular location of the transmission unit by determining the interaural difference of the level of the RF signal received by the left ear hearing device and the level of the RF signal received by the right ear hearing device, and wherein said rough estimation is used to initialize the estimation of the azimuthal angular location of the transmission unit once the voice activity is detected again.

19. The system of claim 15, wherein the hearing devices are adapted to set the estimation of the azimuthal angular location of the transmission unit to the viewing direction of the user once no voice activity has been detected for more than a given threshold time period.

20. The system of claim 15, wherein the hearing devices are adapted to set the estimation of the azimuthal angular location of the transmission unit to the viewing direction of the user only in case that the interaural RF signal level difference determined during the time period during which no voice activity has been detected had a variation above a given threshold.

21. The system of claim 1, wherein each hearing device is adapted to estimate a degree of correlation between the audio signal received from the transmission unit and the audio signal captured by the microphone of the hearing device and to adjust the angular resolution of the estimation of the azimuthal angular location of the transmission unit according to the estimated degree of correlation.

22. The system of claim 21, wherein the hearing devices are adapted to use in the estimation of the degree of correlation a moving average filter taking into account a plurality of previously estimated values of the degree of correlation.

23. The system of claim 21, wherein the hearing devices are adapted to accumulate audio signals over a period of time to take into account a time difference between the audio signal received by the hearing device from the transmission unit and the audio signal captured by the microphone of the left hearing device or the right hearing device.

24. The system of claim 21, wherein the hearing devices are adapted to divide the range of possible azimuthal angular locations into a plurality of azimuthal sectors, wherein the number of sectors is increased with increasing estimated degree of correlation.

25. The system of one of claim 21, wherein the heating devices are adapted to interrupt the estimation of the azimuthal angular location of the transmission unit as long as the estimated degree of correlation is below a first threshold.

26. The system of claim 25, wherein the estimation of the azimuthal angular location of the transmission unit consists of three sectors as long as the estimated degree of correlation is above the first threshold and below a second threshold and consists of five sectors as long as the estimated degree of correlation is above the second threshold.

27. The system of claim 1, wherein the hearing devices are adapted to use in the estimation of the azimuthal angular location of the transmission unit a tracking model based on empirically defined transition probabilities between different azimuthal angular locations of the transmission unit.

28. The system of claim 1, wherein the microphone of each hearing device comprises at least two spaced apart microphones, wherein the hearing devices are adapted to estimate, by taking into account a phase difference between the audio signals of the two spaced apart microphones, whether the speaker using the transmission unit is located in front of or behind the user of the hearing devices in order to optimize the estimation of the azimuthal angular location of the transmission unit.

29. The system of claim 1, wherein each hearing device is adapted to apply a Head Related Transfer Function (HRTF) to the audio signal received from the transmission unit according to the estimated azimuthal angular location of the transmission unit in order to enable spatial perception, by the user of the hearing devices, of the audio signal received from transmission unit corresponding to the estimated azimuthal angular localization of the transmission unit.

30. The system of claim 29, wherein each hearing device is adapted to divide the range of possible azimuthal angular locations into a plurality of azimuthal sectors and to identify, at a time, one of the sectors as the estimated azimuthal angular location of the transmission unit, wherein a separate HRTF is assigned to each sector, and wherein, when the estimated azimuthal angular location of the transmission unit changes from a first one of the sectors to a second one of the sectors, at least one HRTF interpolated between the HRTF assigned to the first sector and the HUT assigned to the second sector is applied to the audio signal received from the transmission unit for a transition period of time.

31. The system of claim 29, wherein the FIRM are subject to dynamic compression, wherein for each frequency bin gain values outside a given range are clipped.

32. The system of claim 1, wherein the system comprises a plurality of transmission units to be used by different speakers and is adapted to identify that one of the transmission units as the active transmission unit whose speaker is presently speaking, with the hearing devices being adapted to estimate the angular localization of the active transmission unit only and to use only the audio signal received from the active transmission unit for stimulation of the user's hearing.

33. The system of claim 32, wherein the hearings devices are adapted to store the last estimated azimuthal angular location of each transmission unit and to use the last estimated azimuthal angular location of the respective transmission unit to initialize the estimation of the azimuthal angular location when the respective transmission is identified again as the active unit.

34. The system of claim 33, wherein each hearing device is adapted to move, once a change of the estimated azimuthal angular location of at least two of the transmission units by the same angle is found, the stored last estimated azimuthal angular location of the other transmission units by that same angle.

35. The system of claim 1, wherein the system comprises a plurality of transmission units to be used by different speakers, wherein each hearing device is adapted to estimate, in parallel, the azimuthal angular location of at least two of the transmissions units, to process the audio signal received from said at least two transmission units, to mix the processed audio signals, and to stimulate the user's hearing according to said mixed processed audio signals, wherein the audio signals are processed such that the angular localization impression of the audio signals from each of said at least two transmission units as perceived by the user corresponds to the estimated azimuthal angular locations of the respective transmission units.

36. The system of claim 1, wherein each hearing device comprises a hearing instrument and a receiver unit, wherein the receiver unit is mechanically and electrically connected to the hearing instrument or is integrated within the hearing instrument.

37. The system of claim 36, wherein the hearing instrument is a hearing aid or an auditory prosthesis.

38. A method of providing hearing assistance to a user, comprising:

capturing, by a microphone of a left ear hearing device and by a microphone of a right ear hearing device, audio signals from ambient sound;

receiving, by the left ear heating device and the right ear hearing device, an RF signal from a transmission unit via the wireless RF link, estimating, by each of the hearing devices, an angular location of the transmission unit by determining a level of the RF signal received by the left ear hearing device and a level of the RF signal received by the right ear hearing device;

determining a level of the audio signal captured by the microphone of the left hearing device and a level of the audio signal captured by the microphone of the right hearing device;

determining a phase difference between the audio signal received via the RF link from the transmission unit by the left ear hearing device and the audio signal captured by the microphone of the left ear hearing device and a phase difference between the audio signal received via the RF link from the transmission unit by the right ear hearing device and the audio signal captured by the microphone of the right ear hearing device, exchanging, via a binaural link, data representative of the determined level of the RF signal, the determined level of the audio signal and the determined phase difference between the hearing devices, estimating, separately in each of the hearing devices, an azimuthal angular location of the transmission unit;

processing, by each hearing device, the audio signals received from the transmission unit via the wireless link; and providing, from the left and right hearing device, processed audio based on the processed audio signals, wherein the processed audio is configured to create a hearing perception such that an angular localization impression of the audio signals from the transmission unit as perceived by a user corresponds to the estimated azimuthal angular location of the transmission unit.

* * * * *